United States Patent [19]

Haselton et al.

[11] 3,970,339

[45] July 20, 1976

[54] DOUBLE SWINGING LATCHBOLT

[75] Inventors: Philip H. Haselton, Short Hills; Frederick W. Geils, Fair Lawn, both of N.J.

[73] Assignee: Detex Corporation, New York, N.Y.

[22] Filed: Jan. 15, 1975

[21] Appl. No.: 541,080

[52] U.S. Cl. ..... 292/227

[51] Int. Cl.[2] ..... E05C 3/22

[58] Field of Search ..... 292/108, 113, 66, 210, 292/227

[56] References Cited

UNITED STATES PATENTS

| | | | |
|---|---|---|---|
| 2,351,314 | 6/1944 | Ario | 292/108 |
| 2,709,910 | 6/1955 | Vigmostad | 292/210 X |

*Primary Examiner*—Richard E. Moore

*Attorney, Agent, or Firm*—Eisenman, Allsopp & Strack

[57] ABSTRACT

There is disclosed a latchbolt assembly which replaces conventional rectilinear latchbolt movement with dual direction swinging movement to reduce binding forces and which uses two independently operable dead latches in association with the dual swinging motions of the latchbolt. To facilitate release, as by key or panic bar actuation, the load of the latchbolt mass and friction is substantially eliminated by coupling the release system to one of the dead latches and thereafter utilizing camming action derived from the opening of the door to swing the latchbolt out of its keeper. Thus hard pressure against the door will not hamper the release. The second dead latch is operated by a latch feeler finger which frees the latchbolt only when the door is open thereby to facilitate relatching by swinging into the keeper as the door closes.

14 Claims, 8 Drawing Figures

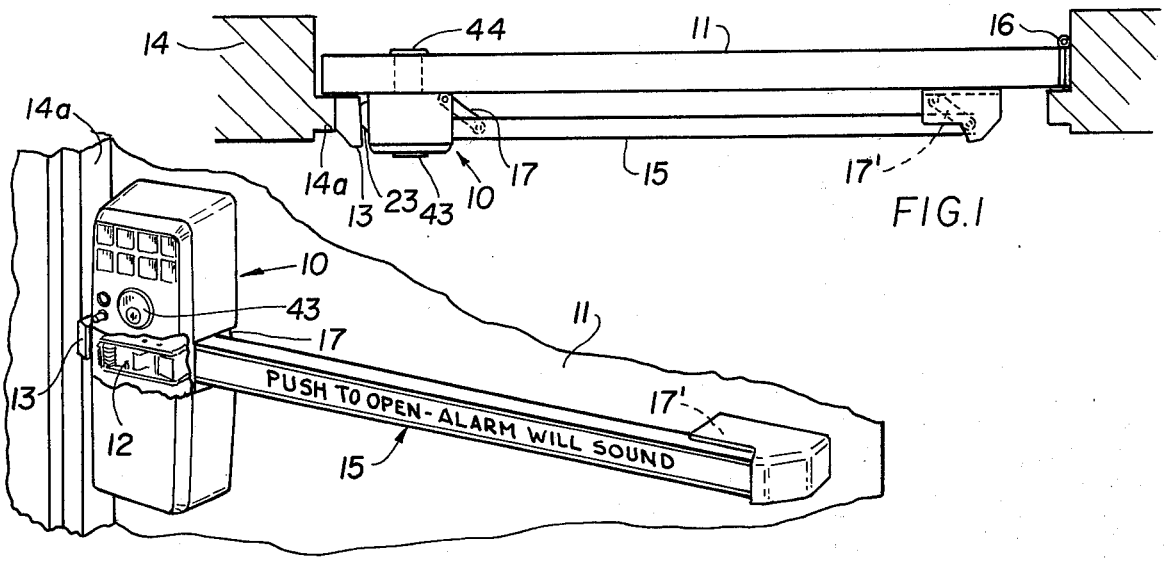
FIG.1
FIG.2
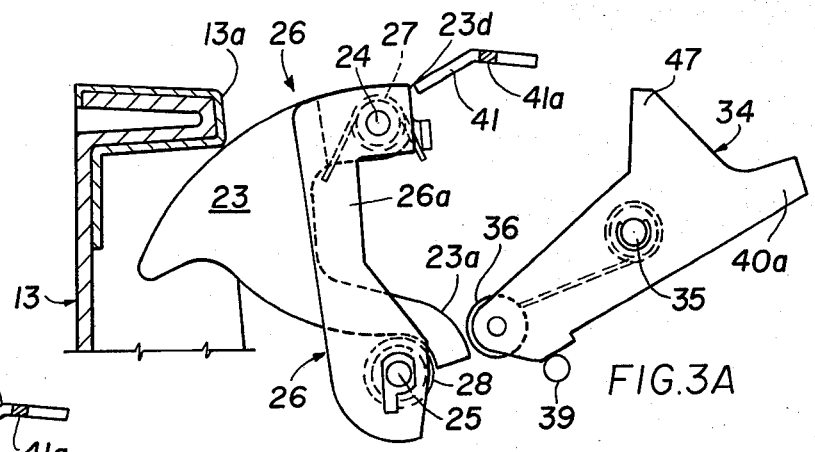
FIG.3A
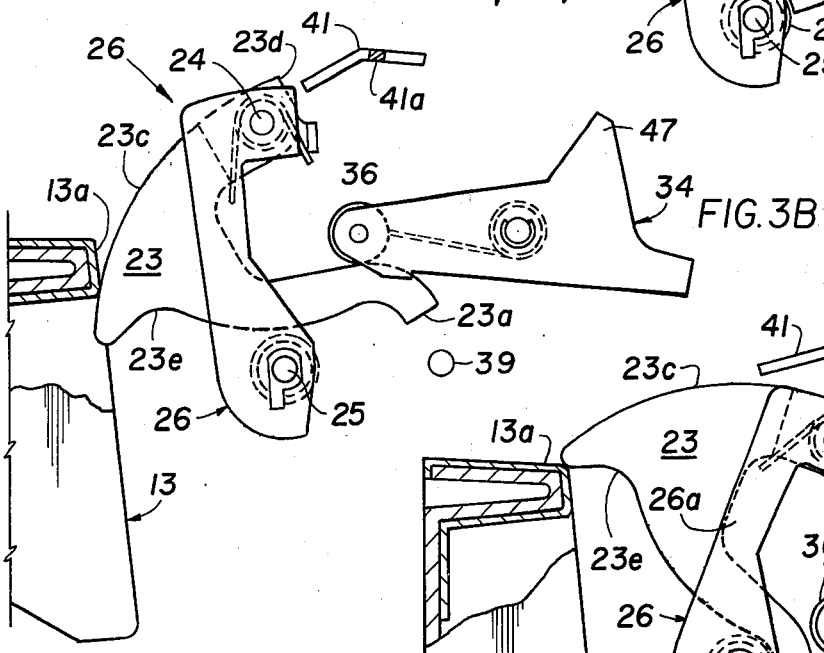
FIG.3B
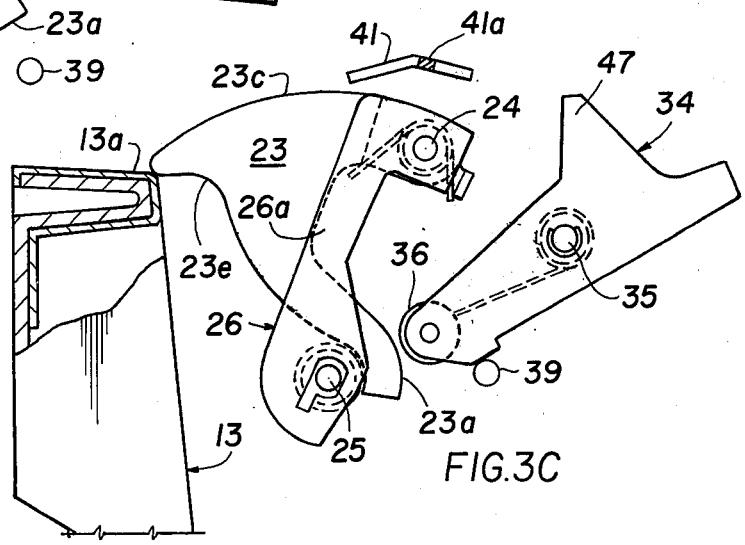
FIG.3C

DOUBLE SWINGING LATCHBOLT

BACKGROUND OF THE INVENTION

The invention relates to lock systems, particularly heavy duty lock systems, useful for example in exit and entry control hardware for commercial and public structures.

Heavy duty door latching and locking hardware, because of its typically rugged construction and of the stresses to which it is subjected, is susceptible to binding particularly in the latchbolt which in most prior art designs is adapted to be slid in and out of its keeper in rectilinear or sliding movements. For example, the pressure of people against a door when attempting an emergency exit can so stress a dead latched latchbolt that severe binding can occur. Panic bars are typically designed to overcome such stresses by brute force, although the strains on the internal linkage can approach the breaking point.

In normal non-emergency use the relatively small torque generated by a hand key is often inadequate to withdraw a latchbolt in which binding has occurred as a result for example of a poor fit in the keeper.

The present invention has for its object to overcome these and other disadvantages of prior art designs by providing a dual direction swinging mount for the latchbolt which enables it to swing in one direction to release the door for opening and to swing in the other direction to permit re-latching when the door closes. Dual dead latches are also provided to secure the latchbolt from unauthorized release in either direction of swinging movement. The latchbolt is contoured to present camming surfaces to the keeper for both directions of door movement and is further contoured on an inner edge to clear the primary dead latch linkage after initial release occurs.

The primary dead latch opposes swinging movement of the latchbolt out of its keeper under the pressure of the camming surface of the latchbolt engaging the keeper when an attempt is made to open the door. When released from its dead latch the latchbolt is cammed out of its keeper by the movement of the opening door. Thus the latchbolt becomes a passive rather than active element in the door unlocking process. The primary dead latch includes a double-armed rock shaft carrying a roller between its arms which blocks the swinging movement. The dead latch assembly is normally backed against stops by a spring causing it to assume a position in which it is over-centered or toggled so that the force on the latchbolt serves only to seat the dead latch more firmly. Release of the primary dead latch can be effected for example through a key-operated linkage in which the key through linkage swings the double arm rocker through a sufficient angle to pass over the center point of the toggle at which time movement of the door causes the keeper to operate on the front cam surface of the latchbolt to swing the latchbolt out of its latching position. Once out of the keeper, the spring of the rocker arms pushes the latchbolt back to its outermost position. It will be understood that the primary dead latch can also be released by other mechanisms, such for example as a panic bar, which when moved causes the rocker arms to swing through a sufficient angle to clear the latchbolt from its dead latch position.

The secondary dead latch, which prevents swinging of the latchbolt in the opposite direction, includes a tiltable latch plate, spring biased to a position which normally engages the end of the latchbolt remote from that of the primary dead latch. Thus the latchbolt cannot be "picked" by inserting a tool into the space between the keeper and the latchbolt housing.

When a door is opened pursuant to authorized release, once past the keeper the latchbolt swings back out to its normal position. Concurrently with this outward swinging movement, a feeler arm which is normally held in the edge of the keeper, swings outwardly under a spring biasing carrying with it a camming surface which moves the latch plate of the secondary dead latch away from and clear of the latchbolt thereby freeing the latchbolt to swing inwardly as the door closes. A rearwardly facing camming surface on the latchbolt engages the edge of the keeper to force the latchbolt inwardly allowing it to relatch. The feeler finger is also cammed inwardly at the same time but does not enter the keeper aperture but rather remains in its inward position thereby permitting the dead latch plate to assume the latching position in the path of swinging movement of the latchbolt.

BRIEF DESCRIPTION OF THE DRAWINGS

FIG. 1 is a top view, diagrammatic in nature, of a hinged door shown closed in its frame and to which is attached locking mechanism in accordance with the present invention;

FIG. 2 is a view in front elevation of a section of a door showing the lock mechanism of the present invention;

FIG. 3A is a view taken on the line 3A—3A of FIG. 2 looking in the direction of the arrows and showing the latchbolt seated in its keeper;

FIG. 3B is a view corresponding to FIG. 3A showing the position of the depressed latchbolt as it releases from its keeper;

FIG. 3C is a view corresponding to FIG 3A showing the door approaching its closed position and showing the latchbolt swung inwardly in order to clear the barrier of the keeper in the process of relatching;

DESCRIPTION OF THE PREFERRED EMBODIMENT

Figure 4:
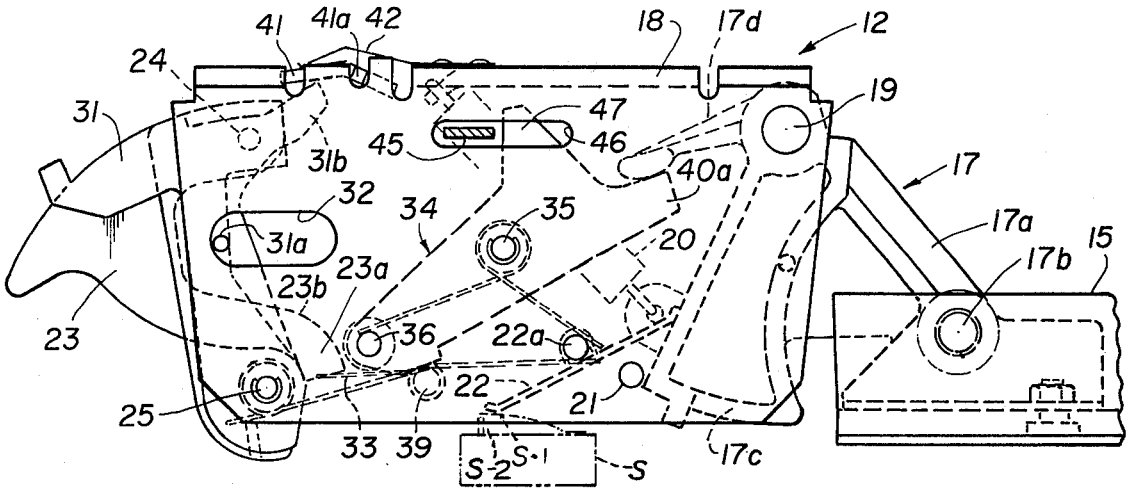
FIG. 4 is a top view of the complete latching assembly and illustrating also panic bar mechanism for emergency release of the latchbolt.

Referring to FIGS. 1 and 2, the invention, which is concerned primarily with a latchbolt assembly, is illustrated as embodied in an exit and entry control system for doors, particularly those in public and commercial structures. The complete system includes a housing 10 secured on the inner surface of an outwardly swinging door 11. Contained within the housing 10 is a latchbolt assembly 12, as well as a multi-mode control unit and alarm system which are disclosed and claimed in copending application Ser. No. 545,922, filed Jan. 31, 1975 and having a common assignee herewith.

The latchbolt assembly 12 operates in conjunction with a keeper 13 which is secured to a door frame 14, typically on its door stop **14*a*. In the system as illustrated, it is intended that the door be opened by means of a panic bar 15 at one end on a swinging link 17 mounted in the latchbolt assembly 12 and at its other end, adjacent the door hinge 16, on a swinging link 17'** with both links 17 and 17′ being normally spring biased outwardly to present the panic bar 15 in a position spaced away from the face of the door. When pushed in the direction of opening of the door, the panic bar swings in a plane which is perpendicular to the surface of the door and moves slightly to the right as viewed in the drawings.

Figure 5:
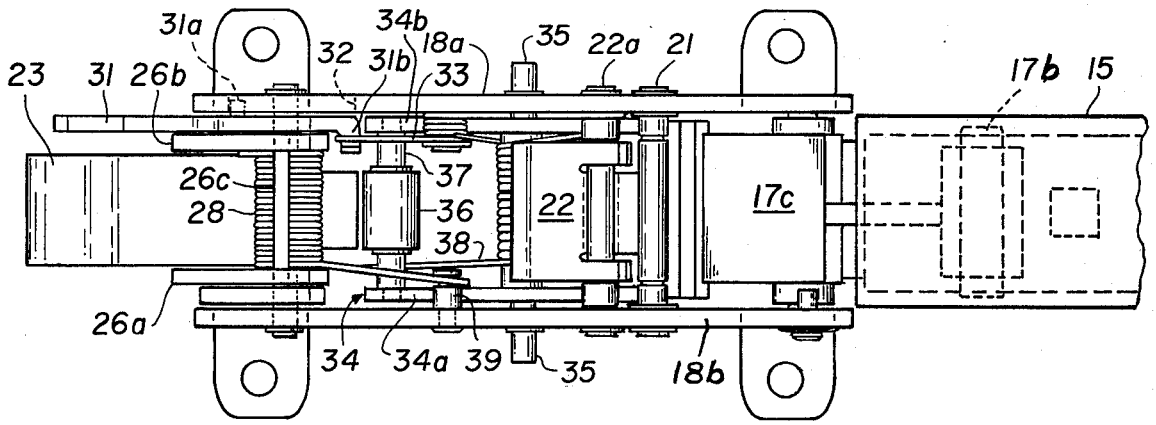
FIG. 5 is a front view of the latch assembly of FIG. 4.

As best seen in FIGS. 4 and 5, the swinging link 17 takes the form of a bell crank having a first arm 17*a* which includes a pivotal coupling 17*b* with the panic bar 15. The bell crank link is pivotally secured by means of an arbor 19 to the frame 18 of the latch assembly 12. A second arm 17*c* of the bell crank is connected to the frame 18 by means of a coil spring 20 which urges it in a counterclockwise direction, as viewed in FIG. 4, against a stop 21. The stop 21 thus fixes the outer position of the panic bar 15. The arm 17*c* also engages a rocker plate 22 mounted on a pivot 22*a* in the frame 18. The rocker plate 22 engages a switch S (shown in broken lines) which controls an alarm system, the details of which are disclosed in the said co-pending application. The switch S is opened when the panic bar 15 is in its inactive or outer position causing the pivot plate 22 to press down against a switch spring S-1 and switch actuator S-2. When the panic bar 15 is pressed inwardly, the bell crank arm 17*c* rotates in a counter-clockwise direction, allowing the pivot plate 22 to swing in a clockwise direction under the force of the switch spring S-1, thereby actuating the alarm system. The bell link 17 includes a third arm 17*d* which actuates a dead latch release mechanism described at a later point.

Figure 6:
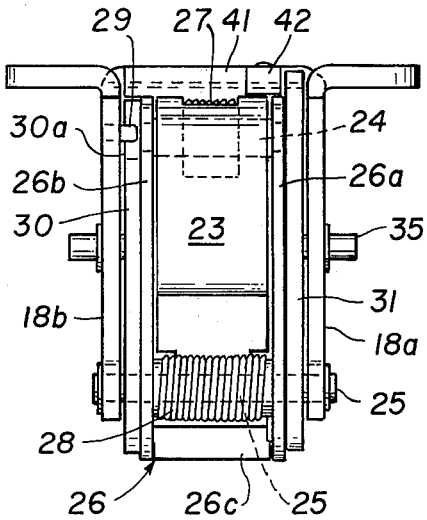
FIG. 6 is an end view of the latchbolt assembly.

The latch assembly 12 includes as its basic latching element a latchbolt 23 normally seated in the keeper 13 to secure the door in its locked condition. The latchbolt 23 is pivotally mounted in the frame 18 for swinging movement in both clockwise and counterclockwise directions. In the illustrated embodiment of the invention, two spaced apart pivot axes are utilized in the form of arbors 24 and 25. The arbor 25 is carried by the side walls 18*a* and 18*b* of the frame 18, as best seen in FIG. 6. A yoke assembly 26 including a pair of spaced apart arms 26*a* and 26*b* having a crosspiece 26*c* at one end is pivotally mounted on the arbor 25 to swing inwardly from right to left as viewed in FIG. 4. The outer or free ends of the arms 26*a* and 26*b* carry the arbor 24 on which the latchbolt is pivotally mounted so it can swing in a counterclockwise direction, as viewed in FIG. 4. A coil spring 27 around the arbor 24, best seen in FIG. 3A, biases the latchbolt in a clockwise direction, and a coil spring 28 around the arbor 25 biases the yoke 26 in a counterclockwise direction, both forcing the latchbolt to its outermost or latching position as shown. This outermost position is fixed by a stop 29 on the frame part 18*b* (FIG. 6) engaging a recess 30*a* in a stop plate 30 which is fixed to the yoke arm 26*b* to move as one therewith. The outermost position of the latchbolt 23 in its direct swinging movement on the arbor 24 is defined by the tail 23*a* of the latchbolt which rests on the coil spring 28 surrounding the arbor 25 (FIGS. 3A and 4).

Also pivotally mounted on the arbor 25 and able to swing free of the yoke 26 is a feeler finger 31 carrying a stop pin 31*a* (FIG. 4) received in a slot 32 in the frame wall 18*a*. The feeler finger is biased to its outer position by a spring 33 which engages an offset tail portion 31*b* of the feeler 31.

The latchbolt 23 is secured against rotation by a primary dead latch assembly comprising a rocker assembly 34 pivoted on an arbor 35 and comprising a pair of spaced apart arms 34*a* and 34*b* carrying a dead latch roller 36 on a cross shaft 37 joining the outer ends of the arms 34*a* and 34*b*. The dead latch rocker assembly 34 is urged by a spring 38 against a stop pin 39 which positions the dead latch roller 36 opposite the tail piece 23*a* of the latchbolt 23. As best seen in FIGS. 3A and 4, the dead latch rocker assembly is slightly overcentered with respect to the tail piece 23*a* so that a toggle lock is effected when the latchbolt 23 is stressed in a counterclockwise direction. The force generated by attempted rotation of the latchbolt in that direction presses the dead latch rocker assembly more tightly against its stop pin 39.

The dead latch rocker assembly 34 also includes tail extensions 40*a* and 40*b* which are engaged by the end of the third arm 17*d* of the bell crank linkage coupled to the panic bar 15. When the panic bar 15 is pressed inward, the arm 17*d* moves in a counterclockwise direction as viewed in the drawings, tilting the dead latch rocker assembly 34 in a clockwise direction to free the roller 36 from the tail piece 23*a* of the latchbolt. The latchbolt 23 is then free to rotate in a counterclockwise direction with the roller 36 riding on a contoured surface 23*b* on the inner face of the latchbolt, as best seen in FIG. 3B.

Actual rotation of the latchbolt 23 in the counterclockwise direction is effected by means of the contoured camming surface 23*c* engaging barrier wall 13*a* of the keeper 13. This force is generated by the person or persons who push the door open. In this fashion, the latchbolt withdrawal action is generated not by the control linkage but by the act of opening the door. Because the latchbolt swings, as opposed to sliding in more conventional rectilinear motion, binding of the latchbolt does not occur. The relatively small forces which are imposed on the dead latch rocker assembly when it is attempted to push the door open prior to release, are easily overcome by the panic bar actuated linkage because the slight overcentering or toggle action is precisely determined, with the roller 36 further reducing the frictional load. As soon as the latchbolt clears the barrier 13*a* of the keeper 13, it will swing to its initial position in a clockwise direction under the influence of the spring 27.

A secondary dead latch assembly is provided to prevent rotation of the latchbolt 23 in a clockwise direction about the arbor 25. Rotation in this direction is normally prevented by a pivotally supported dead-latch plate 41 urged about its pivots 41*a* by a leaf spring 42 in a counterclockwise direction to intercept a tail surface 23*d* on the latchbolt 23. The swinging feeler finger 31 includes a tail portion 31*b* which engages the dead latch plate 41 when the former is in its outer position as shown in FIG. 4, thus lifting the latch plate to release the latchbolt 23 to swing in a clockwise direction about its arbor 25. When the feeler finger is held in its innermost position, however, engaging an edge of the keeper 13, as seen in FIG. 2, the dead latch pivot plate 41 is spring-biased into its dead latching position. Thus, when the door is latched in its keeper, the latchbolt 23 cannot be rotated either in a clockwise or counterclockwise direction and thereby is resistant to picking. When the door is opened the feeler finger 31 swings outwardly to release the dead latch so that the latchbolt can be swung inwardly in clockwise direction about the arbor 25 by the camming action of its contoured trailing surface 23*e* against the barrier 13*a* of the keeper 13. The latchbolt is then able to relatch within the keeper when the door is fully seated against the door jamb.

As thus far described, the door cannot be opened without pressing the panic bar to release the dead latch rocker assembly 34 and free the latchbolt 23 to be cammed inwardly around the keeper as the door is pushed open by the exiting person. At such time and as more fully described in said co-pending application, an alarm system will sound through the action of the switch S indicating the door has been opened. The latch mechanism as described above can also be operated with a key. Key actuated entry or exit can be accomplished from the outside or from the inside by means of locks 43 and 44 on the inside and outside, respectively, of the door 11. As more fully described in said co-pending application, an actuating finger 45 (FIG. 4) is received in a slot 46 in the frame wall 18*a* next to an extension 47 on the dead latch rocker assembly 34. When the key is turned in the lock, the finger 45 engages the extension 47 to tilt the rocker assembly to free the dead latch roller from the tail piece 23*a* of the latchbolt 23.

It should be noted that the locking and latchbolt assembly is essentially symmetrical and can therefore be used on either the left hand side (as shown) or the right hand side of a door, it being required, however, that the assembly be inverted so that the housing side 18*b* is disposed upwardly.

While the invention has been described above referring to a preferred embodiment thereof, it will be understood that it can take various other forms and arrangements within the scope of the present invention. Thus, for example, a variety of configurations of the double swinging latchbolt can be made with compensating revisions in the specific nature of the dead latching mechanism. Also, a single pivot axis can be used for the double swinging latchbolt rather than two spaced apart pivot axes or arbors as shown in the drawing, sacrificing, however, certain ability to confine the apparatus within a relatively small space and further changing the moment arms of the mechanism. The invention should not, therefore, be regarded as limited except as defined in the following claims:

We claim:

1. A latchbolt assembly for mounting on a door hinged to a door frame carrying a complementary latch keeper, comprising a housing for the assembly, a movable lachbolt mounted in the housing for swinging movement in both clockwise and counterclockwise directions from a centralized latching position and in which the axes of the hinged door and of the swinging movement of the latchbolt are substantially parallel, and releasable deadlatch means to secure the latchbolt against swinging movement in either direction when it is disposed in its centralized position in the latch keeper to secure the door shut in its frame, whereby the swinging movement of the latchbolt in one direction frees the latchbolt from the keeper and the swinging movement in the other direction admits the latchbolt into the keeper as the door is shut.

2. A latchbolt assembly for doors as set forth in claim 1 said dead latch means including two dead latches to respectively secure the latchbolt against rotation in clockwise and counterclockwise directions.

3. A latchbolt assembly as set forth in claim 2, including a movable dead latch feeler arm to sense the door closed and opened positions, and means connecting the feeler arm to one of said dead latches to release the latter when the door is open.

4. A latchbolt assembly for doors as set forth in claim 2, including exit control means to release said second dead latch.

5. A latchbolt assembly as set forth in claim 1, including two spaced apart arbors defining two spaced apart axes of rotation for the latchbolt, a swinging carrier pivotally mounted on one arbor, said second arbor being supported by the carrier and said latchbolt being pivotally supported by the second arbor, whereby the latchbolt and carrier swing as one about the first arbor in a first direction and the latchbolt swings about the second arbor in the other direction.

6. A latchbolt assembly as set forth in claim 5, including spring means urging the latchbolt in an outward direction about the respective arbor axes.

7. A latchbolt assembly as set forth in claim 5, including first and second deadlock latches to releasably secure the latchbolt against rotation about its respective axes in clockwise and counterclockwise directions, said first dead latch means comprising pivot arm means spring biasd to an active position intercepting the latchbolt to preclude rotation thereof in one direction, a first actuator to rotate the pivot arm means to release the latchbolt, manually-operated door opening means connected to the first actuator, a second actuator to rotate the pivot arm means, and key-actuated means connected to the second actuator.

8. A latchbolt assembly as set forth in claim 7, including stops to preclude rotation of the pivot arm means in one direction and also to position the pivot arm in an over-centered position, whereby pressure on the pivot arm means by the latchbolt urges the latchbolt more tightly against the stops.

9. A latchbolt assembly as set forth in claim 2, including roller bearing means interposed between the latchbolt and the pivot arm means.

10. A latchbolt assembly as set forth in claim 5, said latchbolt including contoured forwardly and rearwardly facing edges defining camming surfaces to react against the keeper to push the latchbolt toward the door to both release and relatch the latchbolt.

11. A latchbolt assembly as set forth in claim 5, including an electrical switch actuator connected to said first actuator and alarm means connected to said switch.

12. A latchbolt assembly as set forth in claim 7, including a dead latch feeler arm carried by the housing and normally interposed in a position to intercept a stationary door frame part when the door is closed, and means coupled to said feeler arm to release said second dead latch means when the door is open, whereby the door can be closed by permitting the latchbolt to swing inwardly to relatch in the keeper.

13. A latchbolt assembly as set forth in claim 8, said pivot arm means comprising a pair of spaced-apart arms, a roller bearing mounted between the said arms to engage the latchbolt, resilient means urging the pivot arm means against said stops, and cam means on the inner edge of the latchbolt to engage the roller bearing to move the pivot arm means in a direction further away from the dead latching position when the pivot arm means has been released from its dead latching position.

14. A latchbolt assembly as set forth in claim 13, said second dead lock latches including a pivotally mounted plate engaging the back side of the latchbolt at a point spaced from the second arbor, spring means urging the plate to its dead lock latching position and cam means on the dead lock latch feeler arm to move the plate out of its dead lock latching position when the door is open.

* * * * *